US012091781B2

(12) United States Patent
Carls et al.

(10) Patent No.: US 12,091,781 B2
(45) Date of Patent: Sep. 17, 2024

(54) SILK-LIKE WOVEN GARMENT CONTAINING OR CONSISTING OF LYOCELL FILAMENTS

(71) Applicant: LENZING AKTIENGESELLSCHAFT, Lenzing (AT)

(72) Inventors: Susanne Carls, Lenzing (AT); Martin Neunteufel, Hong Kong (CN); Dieter Eichinger, Fürstenfeld (AT); Christoph Schrempf, Bad Schallerbach (AT); Mohammad Abu-Rous, Vienna (AT)

(73) Assignee: Lenzing Aktiengesellschaft, Lenzing (AT)

( * ) Notice: Subject to any disclaimer, the term of this patent is extended or adjusted under 35 U.S.C. 154(b) by 725 days.

(21) Appl. No.: 16/652,703

(22) PCT Filed: Sep. 19, 2018

(86) PCT No.: PCT/EP2018/075337
§ 371 (c)(1),
(2) Date: Apr. 1, 2020

(87) PCT Pub. No.: WO2019/068467
PCT Pub. Date: Apr. 11, 2019

(65) Prior Publication Data

US 2020/0240051 A1 Jul. 30, 2020

(30) Foreign Application Priority Data

Oct. 6, 2017 (EP) ..... 17195315

(51) Int. Cl.
*D02G 3/02* (2006.01)
*D03D 15/225* (2021.01)
(Continued)

(52) U.S. Cl.
CPC ..... *D02G 3/02* (2013.01); *D03D 15/225* (2021.01); *D03D 15/30* (2021.01); *D03D 15/41* (2021.01);
(Continued)

(58) Field of Classification Search
CPC ..... D02G 3/02; D03D 15/225; D03D 15/41; Y10T 442/3065; D10B 2201/02; D10B 2403/01; D10B 2401/00
(Continued)

(56) References Cited

U.S. PATENT DOCUMENTS 4,246,221 A 1/1981 McCorsely, III
5,120,463 A 6/1992 Bjork et al.
(Continued)

FOREIGN PATENT DOCUMENTS

CN 101457436 A 6/2009
CN 102312324 A 1/2012
(Continued)

OTHER PUBLICATIONS

JP 2009102759 A (Year: 2009).*
(Continued)

*Primary Examiner* — Matthew D Matzek
(74) *Attorney, Agent, or Firm* — Venable LLP

(57) ABSTRACT

Silk woven fabric is known and renowned for its touch. The drawback of silk, however, is its price, its poor washability, and low resistance against certain chemical treatments. It is therefore the object of the invention to provide a silk-like woven fabric which overcomes these problems. According to the invention, this problem is solved by providing a silk-like woven fabric (2) made from weft yarns (4) and warp yarns (6), wherein at least one of the weft yarns (4) and the warp yarns (6) contains or consists of lyocell filaments (8). Especially twisted lyocell filament yarns are used, the
(Continued)

resulting material has a touch comparable to silk and physical properties that are equal to or even surpass those of silk. Moreover, the lyocell filament yarns (4, 6) may have a higher twist than silk yarns, other cellulose yarns, or synthetic yarns.

12 Claims, 1 Drawing Sheet

(51) Int. Cl.
*D03D 15/30* (2021.01)
*D03D 15/41* (2021.01)

(52) U.S. Cl.
CPC ..... *D10B 2201/22* (2013.01); *D10B 2401/00* (2013.01); *D10B 2403/01* (2013.01); *Y10T 442/3065* (2015.04)

(58) Field of Classification Search
USPC ..... 442/189
See application file for complete search history.

(56) References Cited

U.S. PATENT DOCUMENTS

| | | | | |
|---|---|---|---|---|
| 5,310,424 | A | 5/1994 | Taylor | |
| 5,580,354 | A | 12/1996 | Taylor | |
| 5,589,125 | A | 12/1996 | Zikeli et al. | |
| 5,798,125 | A | 8/1998 | Zikeli et al. | |
| 5,914,443 | A | 6/1999 | Kalum | |
| 5,930,989 | A | 8/1999 | Nakagawa et al. | |
| 5,968,434 | A | 10/1999 | Zikeli et al. | |
| 6,013,367 | A | 1/2000 | Nakagawa et al. | |
| 8,551,751 | B2 | 10/2013 | Emalfarb et al. | |
| 10,030,323 | B2 | 7/2018 | Durnberger et al. | |
| 2004/0117923 | A1 | 6/2004 | Taylor et al. | |
| 2006/0207706 | A1 | 9/2006 | Kwon et al. | |
| 2007/0031664 | A1 | 2/2007 | Kuwano et al. | |
| 2008/0057812 | A1 | 3/2008 | Kataoka et al. | |
| 2009/0099079 | A1 | 4/2009 | Emalfarb et al. | |
| 2010/0297905 | A1 | 11/2010 | Ulrich et al. | |
| 2010/0330351 | A1* | 12/2010 | Crnoja-Cosic | D03D 1/0041 442/310 |
| 2011/0146832 | A1 | 6/2011 | Hsu et al. | |
| 2011/0223398 | A1* | 9/2011 | Dobin | D03D 15/225 428/196 |
| 2013/0037163 | A1* | 2/2013 | Teshima | D02G 3/406 139/420 R |
| 2013/0055497 | A1 | 3/2013 | Zhu | |
| 2016/0060792 | A1 | 3/2016 | Durnberger et al. | |
| 2016/0326671 | A1 | 11/2016 | Schrempf et al. | |
| 2017/0159214 | A1 | 6/2017 | Sundararajan | |
| 2017/0175302 | A1 | 6/2017 | Habicht et al. | |
| 2018/0355518 | A1 | 12/2018 | Durnberger et al. | |
| 2020/0240051 | A1 | 7/2020 | Carls et al. | |
| 2020/0291551 | A1 | 9/2020 | Carls et al. | |
| 2020/0308737 | A1 | 10/2020 | Carls et al. | |

FOREIGN PATENT DOCUMENTS

| | | | | | |
|---|---|---|---|---|---|
| CN | 203307521 | U | | 11/2013 | |
| CN | 104674442 | A | | 6/2015 | |
| CN | 105102700 | A | | 11/2015 | |
| CN | 105455262 | A | | 4/2016 | |
| CN | 104726986 | A | | 6/2016 | |
| CN | 105648634 | A | | 6/2016 | |
| CN | 105747335 | A | | 7/2016 | |
| CN | 205474191 | U | | 8/2016 | |
| CN | 106367880 | A | | 2/2017 | |
| CN | 107142590 | A | * | 9/2017 | D03D 13/008 |
| CN | 108193340 | A | | 6/2018 | |
| EP | 0538977 | A1 | | 4/1993 | |
| EP | 1493850 | A1 | | 1/2005 | |
| JP | H05-117970 | A | | 5/1993 | |
| JP | H07-157968 | A | | 6/1995 | |
| JP | H09-137386 | A | | 5/1997 | |
| JP | H09-143836 | A | | 6/1997 | |
| JP | H10-08337 | A | | 1/1998 | |
| JP | H10-25638 | A | | 1/1998 | |
| JP | H10-25642 | A | | 1/1998 | |
| JP | H1018145 | A | | 1/1998 | |
| JP | H10-72771 | A | | 3/1998 | |
| JP | H1072740 | A | * | 3/1998 | |
| JP | H10-88450 | A | | 4/1998 | |
| JP | H10-131038 | A | | 5/1998 | |
| JP | H10-251983 | A | | 9/1998 | |
| JP | H11-315471 | A | | 11/1999 | |
| JP | H11335935 | A | | 12/1999 | |
| JP | 2000-054268 | A | | 2/2000 | |
| JP | 3143638 | B2 | | 1/2001 | |
| JP | 2005-113333 | A | | 4/2005 | |
| JP | 2008-156760 | A | | 7/2008 | |
| JP | 2009102759 | A | * | 5/2009 | |
| JP | 2014-118662 | A | | 6/2014 | |
| KR | 10-0316542 | B1 | | 2/2002 | |
| KR | 1020030087215 | A | | 11/2003 | |
| KR | 10-0587474 | B1 | | 6/2006 | |
| RU | 2043437 | C1 | | 9/1995 | |
| TW | 389799 | B | | 5/2000 | |
| TW | 1314597 | B | | 9/2009 | |
| TW | M521636 | U | | 5/2016 | |
| WO | 93/19230 | A1 | | 9/1993 | |
| WO | 95/00697 | A1 | | 1/1995 | |
| WO | 02/31236 | A1 | | 4/2002 | |
| WO | 03/012183 | A1 | | 2/2003 | |
| WO | 03/099047 | A2 | | 12/2003 | |
| WO | 2009/079674 | A1 | | 7/2009 | |
| WO | 2010135214 | A1 | | 11/2010 | |
| WO | 2012/027374 | A2 | | 3/2012 | |
| WO | 2012/116384 | A1 | | 9/2012 | |
| WO | 2014/015351 | A1 | | 1/2014 | |
| WO | 2014/100841 | A2 | | 7/2014 | |
| WO | 2014/161018 | A1 | | 10/2014 | |
| WO | 2015/101543 | A1 | | 7/2015 | |

OTHER PUBLICATIONS

International Search Report and Written Opinion issued in corresponding International Application No. PCT/EP2018/075337 (11 pages).
W. Rimpp, "Marketing of Newcell Filament Yarns", Lenzinger Berichte, 75196, pp. 63-67 (1995).
Grüner, "A new and objective measuring technique to analyze the softness of tissue" Emtec Paper Testing Technology, (2012) 11 pages.
Schloßer et al., "Griffbeurteilung von Textilien mittels Schallanalyse", Meilland Textilberichte, 1/2102, p. 43-45.
"Neue und Objektive Messtechnik für Softness-Analyse" in avr-Allgemeiner Vliesstoff Report May 2015, p. 99-101.
ISO 5077:2077, Textiles—Determination of dimensional change in washing and drying.
ISO 6330:2012, Textiles—Domestic washing and drying procedures for textile testing.
ISO 15487:2009, Textiles—Method for assessing appearance of apparel and other textile end products after domestic washing and drying.
DIN EN 20105-A02—Tests for colour fastness of textiles—Greyscale for assessing change in colour (ISO 105-A02).
ISO 12945-2:2000, Textiles—Part 2: Modified Martindale method.
BISFA, "Terminology of man-made fibres," 2009 Edition.
Sarkar, "How to check the Spirality of Fabric" (Aug. 20, 2012).
"Measurement of spirality in knitted fabrics and garments" Fibre2fashion.com.
"How to Check the Spirality of Fabric?—Online Clothing Study" onlineclothingstudy.com.
Cariki, "What is difference between Tencel and Lyocell".

* cited by examiner

SILK-LIKE WOVEN GARMENT CONTAINING OR CONSISTING OF LYOCELL FILAMENTS

CROSS REFRENCE TO RELATED APPLICATIONS

The present application is a national-stage entry under 35 U.S.C. § 371 of International Patent Application No. PCT/EP2018/075337, published as WO 2019/068467 A1, filed Sep. 19, 2018, which claims priority to EP 17195315.1, filed Oct. 6, 2017, the entire disclosure of each of which is hereby incorporated by reference.

BACKGROUND OF THE INVENTION

Field of the Invention

The invention relates to a woven fabric, in particular a silk-like woven fabric, made from weft and warp yarns, wherein at least one of the weft yarn and the warp yarn contains or consists of lyocell filament yarns.

Fabrics made from silk, i.e. silkworm fibers, have a high wearing comfort as it has a high moisture absorption and is smooth and soft to the touch without being slippery. Moreover, silk has a high tenacity, is highly durable and has a high lustre. However, silk is very expensive. It has only a very small elasticity and remains plastically elongated if once stretched. Further, it is vulnerable to insect damage and sensitive to sunlight. Another drawback of silk is its poor washability. To avoid shrinkage, silk must be dry cleaned, and even then shrinkage up to 4% may occur.

Fabrics made from silk are in particular light-weight fabrics such as Crepe, comprising Creponne and Georgette fabrics and medium-weight Doupionne. In the context of this application, silk only designates 100% natural silk.

To avoid the drawbacks associated with silk fabric, there have been many attempts in the past to replicate the wearing comfort of silk with silk-like fabrics using yarn which contains or consists of man-made continuous filaments.

Such man-made continuous filament yarns are widely used in the textile industry to produce fabrics with a distinct character compared to fabrics produced from yarns made using staple fiber. A continuous filament yarn is one in which all of the fibers are continuous throughout any length of the yarn. A continuous filament yarn will commonly consist of 20 to 200 or more individual fibers which are all parallel to each other and the axis of the yarn when produced. The yarn is produced by extruding a solution or melt of a polymer or a polymer derivative and then winding the yarn produced onto a bobbin or reel or by forming a cake by centrifugal winding. For some applications, twisted yarns are used.

Synthetic polymer continuous filament yarns are common. For example, nylon, polyester and polypropylene continuous filament yarns are used in a wide variety of fabrics. They are produced by melt spinning a molten polymer through a spinneret with a number of holes corresponding to the number of fibers required in the yarn produced. After the molten polymer has started to solidify, the yarn may be drawn to orient the polymer molecules and improve the properties of the yarn.

Continuous filament yarns can also be spun from cellulose derivatives such as cellulose diacetate and cellulose triacetate by dry spinning. The polymer is dissolved in a suitable solvent and then extruded through a spinneret. The solvent evaporates quickly after extrusion causing the polymer to precipitate in the form of a yarn. The newly produced yarn may be drawn to orient the polymer molecules.

Continuous filament yarns can further be produced from cellulose using the viscose process. Cellulose is converted to cellulose xanthate by reaction with sodium hydroxide and carbon disulphide and then dissolved in a sodium hydroxide solution. The cellulose solution, commonly called viscose, is extruded through a spinneret into an acid bath. The sodium hydroxide is neutralised causing the cellulose to precipitate. At the same time, the cellulose xanthate is converted back to cellulose by reaction with the acid. The newly formed fiber is drawn to orient the cellulose molecules, washed to remove reactants from the fiber and then dried and wound onto a bobbin. In earlier versions of this process, the wet yarn was collected into a cake using a centrifugal winder—a Topham Box. The cake of yarn was then dried in an oven before winding onto a bobbin.

Continuous filament cellulose yarns are also produced using the cupro process. Cellulose is dissolved in a solution of cuprammonium hydroxide. The resulting solution is extruded into a water bath where the cuprammonium hydroxide is diluted and the cellulose precipitates. The resulting yarn is washed, dried and wound onto a bobbin.

Cellulosic continuous filament yarn produced by either the viscose or the cupro process can be made into fabrics by weaving. Fabrics produced are used for a variety of applications including linings for women's apparel and menswear.

Fabrics made from continuous filament cellulose yarns can have a high lustre. They are good at moisture handling to enhance the comfort of the wearer. They do not generate static electricity as readily as fabrics made using continuous filament synthetic yarns.

Fabrics made from currently available continuous filament cellulose yarns generally have poor physical properties. The dry strength and the tear strength are poor compared to fabrics made from synthetic polymers such as polyester. The wet strength is much lower than the dry strength due to interactions between the cellulose and water. The abrasion resistance is low. The interactions with water also soften the cellulose causing the fabrics made from the yarn to be unstable when wetted. This is particularly problematic when washing these materials in a household washing machine.

Due to these deficiencies, the products which were originally made using continuous filament cellulose yarns are now made mainly by synthetic polymer continuous filament yarns such as polyester and nylon.

However, there are problems with the synthetic yarns. Fabrics made using them do not have the moisture handling capability of fabrics made from cellulose yarns. Synthetic fabrics can generate static electricity. Some people find silk-like fabrics made from the synthetic yarns are much less comfortable to wear than silk. Further, silk-like fabrics made from synthetic yarns have poor washability, requiring dry cleaning to avoid excessive shrinkage.

Thus, there is still no silk-like material available which combines the wearing comfort of silk with its high tenacity and, at the same time, can be washed in a household laundry machine without much shrinkage.

SUMMARY

It is therefore the object of the invention to provide a silk-like woven fabric which is washable, exhibits a similar or superior wearing comfort to silk with regard to moisture absorption and touch, and has a strength similar to silk.

This object is solved by a silk-like woven fabric that is made from weft yarn and warp yarn, wherein at least one of the weft yarn and the warp yarn contains or consists of lyocell filaments.

Such a fabric is washable if the non-lyocell yarns consist of a washable material. It further exhibits a high tenacity and is washable. The luster, softness and smoothness are all comparable to silk. Impact on the environment by the manufacturing process is lower for lyocell than for the other man-made filament yarns.

Lyocell is the generic name given to a type of cellulosic man-made fiber produced by a direct dissolution process. The lyocell process is described e.g. in U.S. Pat. No. 4,246,221 and WO 93/19230.

A slurry of wood pulp is formed with a solution of amine oxide in water. Water is then evaporated from the slurry in a thin film evaporator vessel. When the water level is reduced below a certain level, the cellulose forms a solution in the amine oxide. The resulting viscous liquid solidifies to a glassy solid below about 70° C. If maintained above this temperature, it can be pumped through a spinneret to form filaments which are then immediately immersed in water where the dilution of the amine oxide causes the cellulose to precipitate.

The spinneret used for extrusion of the amine oxide cellulose solution has a number of holes corresponding to the number of filaments required in the continuous filament yarn. After extrusion, the newly formed yarn is washed clean of amine oxide with a counter current flow of water. This washing may be done on self advancing reels on which water is introduced to wash the fiber. A finish may be applied to aid further processing and the yarn is dried. The washed and dried yarn is wound onto a bobbin.

In the lyocell process, cellulose in the form of wood pulp is the only raw material used. The wood pulp used comes from sustainable managed forests. The filaments produced are 100% cellulose and are the only output from the process. The amine oxide solvent is recovered from the washing water and reused to produce further filament. This recovery can be as high as 99.7%. As a result, the environmental impact of the lyocell process is very low. There are virtually no releases of gaseous or liquid emissions from the process and the filament produced is solvent free.

By contrast the viscose process uses carbon disulphide, sodium hydroxide, sulphuric acid and zinc sulphate. Hydrogen sulphide and carbon disulphide can be released from the process unless a great deal of care is taken. Sodium sulphate is produced as a by-product of the process.

The invention can be further improved by the following additional features, which can be combined independent of one another and which each exhibit a different technical effect.

The continuous filament lyocell yarns used to produce the products of the invention may be the as produced yarn in an untwisted state or may be twisted by rewinding. It may be a doubled yarn. It may be combined with another continuous filament yarn or staple fiber yarn by twisting the yarns together or by intermingling using for example an air jet.

According to one aspect of the invention, at least one of the weft yarns and the warp yarns may contain or consist of at least one lyocell filament yarn, the lyocell filament yarn having at least 150 TPM (twists per meter). This allows creating silk-like crepe fabrics. It has been surprisingly found that using lyocell filaments, the twisting of the yarn can be even significantly increased to more than 1500 TPM. If more than 3000 TPM are used in a lyocell filament, crepe-effects can be achieved, that due to this high twist cannot be achieved by other materials. The maximum twist may be at around 3500 TPM. These TPM ranges can be achieved for yarns having a titer between 20 and 150 dtex, both for single, 2-ply and/or 3-ply, independent whether an S- or Z-twist is used. This sets the inventive silk-like woven fabric apart from fabrics that contain viscose or cupro filaments, which can have a maximum TPM of only about 2500. Using the lyocell filament yarn, even higher TPM values can be achieved than with silk filaments at the same or even lower titer, due to the high tenacity of the lyocell filaments.

At least one of the weft yarns and the warp yarns may contain or consist of at least one lyocell filament yarn, which has a linear mass density of no more than 100 dtex. This allows the creation of heavy-weight silk-like fabric, such as Dupionne. For medium-weight silk-like woven fabric, the lyocell filament yarn may have a linear mass density of no more than 70 dtex. For light-weight silk-like woven fabrics, such as Creponne or Georgette, the linear mass density of the at least one lyocell filament yarn may be lower than 30 dtex. The linear mass density of the single lyocell filaments may be between 1.1 and 1.5, preferably between 1.25 and 1.4 dtex.

It is preferred that the silk-like woven fabric has a high resistance against wear. This can be achieved if, after the first wash according to DIN EN 6330, the silk-like woven fabric exhibits a wear number of at least 6000 Martindale in a Martindale abrasion test according to DIN EN ISO 12947-1:2007-04 to whole formation. In particular, if the lyocell filament yarn has a higher linear mass density, e.g. between 50 and 100 dtex, the abrasion resistance may be at least 7500 Martindale.

Another improvement over synthetic silk-like or silk woven fabrics can be attained, if the inventive silk-like woven fabric has at least 3 Martindale after 2000 cycles determined according to the Martindale pilling test in DIN EN ISO 12945-2.

According to another embodiment, the inventive silk-like woven fabric may have a TS7 value as determined by a TSA Tissue Softness Analyzer of no more than 6 in a test using a TSA testing machine in particular for a silk-like lyocell woven fabric containing or consisting of lyocell yarn having less than 300 TPM, less than 10 in particular for a silk-like lyocell woven fabric containing or consisting of lyocell yarn having e.g. between 200 and 1000 TPM, and less than 15 in particular for a silk-like woven fabric having e.g. less than 3000 TPM and more than 1000 TPM. This value is correlated to softness and corresponds to the value of a silk woven fabric.

According to another embodiment, the TS750 value as determined by a TSA Tissue Softness Analyzer may be less than 30 in particular for a silk-like lyocell woven fabric containing or consisting of lyocell yarn having less than 300 TPM, less than 20 in particular for a silk-like lyocell woven fabric containing or consisting of lyocell yarn having between 200 and 1000 TPM, and may be less than 7 in particular for a silk-like lyocell woven fabric containing or consisting of yarn having more than 1000 and in particular less than 3500 TPM.

For a material, which is to be considered superior to silk, washability in a household laundry machine is a necessity. In particular, shrinkage of the silk-like woven fabric according to the invention should be small. This can be achieved if the combined shrinkage, i.e. the sum of the absolute values in percent of the shrinkage in the warp direction and of the shrinkage in the weft direction of the fabric as determined according to DIN EN ISO 5077, after one washing and/or five washings according to DIN EN ISO 6330, and/or at least shrinkage in the direction of the warp and/or weft yarn consisting of or containing lyocell filaments, is no more than 11% in the conditioned state 65/20 after the first wash, in particular for a woven fabric according to the invention which has a warp and/or weft yarn containing or consisting of lyocell yarns and having at least 1500 TPM. Combined shrinkage and/or in particular shrinkage in the direction of the warp and/or weft yarn containing or consisting of the lyocell filaments may be less than 2% especially if the yarn containing or consisting of lyocell filaments has less than 500 TPM.

The conditioned state 65/20, abbreviated as cond. 65/20, describes a state, in which the yarn or fabric has come into equilibrium with its surroundings. Here, the surroundings had an ambient temperature of 20° C. at 65% relative humidity.

The above sum in particular applies to a silk-like woven fabric comprising or consisting of lyocell yarn having between 1500 and 3000 TPM, in particular 1750 and 2250 TPM. The sum of shrinkages may be less than 4% for a lyocell yarn having between 500 and 1750 TPM. It may be less than 3% for a lyocell yarn having between 0 and 500 TPM.

Using the same test conditions according to DIN EN ISO 6330 and DIN EN ISO 5077, and performing five washings, the sum of the absolute values of shrinkage may be less than 19%, in particular for a silk-like woven fabric containing or consisting of lyocell yarn having between 1500 and 3500 TPM, in particular between 1750 and 2250 TPM. For a lyocell yarn having between 500 and 1750 TPM, the sum of shrinkages in percent both in the warp and in the weft direction may be less than 5%. For a lower TPM value, such as between 0 and 500 TPM, the sum may be less than 2%.

The resilience of the silk-like woven fabric according to the invention may also be expressed in the AATC durable press rating determined according to DIN EN ISO 15487 after one and/or five washings. In particular, the silk-like woven fabric according to the invention may have an AATC durable press rating of at least 3 after the first washing and between 4 and 8 after the fifth washing.

Both the AATC durable press rating and the shrinkage values demonstrate independently from one another the superior washability of the inventive silk-like fabric both over synthetic silk-like and silk woven fabrics.

In the test for color fastness according to DIN EN 20105 A02, the inventive silk-like woven fabric may have a grade of at least 5 after the first washing and/or of at least 4 after the fifth washing. Washing is carried out according to DIN EN ISO 6330.

Moisture regain as measured according to ASTMD 1909 of the fabric is an indicator for the comfort level. Mulberry silk has 11% of moisture regain. The test of a lyocell filament shows a moisture regain of 13% therefore a similar or even better wearing comfort is expected. The standard moisture uptake at 20° C. and 65% relative humidity of the lyocell filaments is larger than 10 wt % of their dry weight. Thus, fabrics containing or consisting of lyocell filaments have already a dry touch similar to silk.

The silk-like woven lyocell fabric according to the invention may contain at least 10% lyocell. This content already ensures dimensional stability. In order to create a silk-like woven lyocell fabric which has a distinctive touch, superior dimensional stability and high resistance, more than 30% lyocell may be contained. The lyocell filaments may be blended with synthetic filaments such as viscose and/or other staple fibers.

The silk-like woven lyocell fabrics of the invention may be of any style, weave or finish that is suitable for production with a continuous filament yarn and results in a touch similar to silk. They may be constructed as plain weave, twill, satin, sateen, hopsack, cord and fancy weaves. Fabrics may be woven using any loom suitable for weaving continuous filament yarns including shuttle looms, rapier looms, projectile looms or ribbon looms.

The silk-like woven fabrics produced using continuous filament lyocell yarns can have aesthetics and appearance similar to a fabric produced from continuous filament viscose yarn, but have significantly better physical properties. The higher strength and modulus of the yarn result in improved fabric breaking strength, tear strength, abrasion resistance and stability. The wet fabric properties are also superior.

For example, a woven lining fabric of 70 gm-2 made using continuous filament lyocell yarn has a similar lustre, handle and appearance to a fabric of the same weight and construction produced using continuous filament viscose. However, the properties of the lyocell fabric are considerably better.

The silk-like woven fabrics according to the invention and thus made using continuous filament lyocell yarn can be used to produce outerwear garments, linings for use in structured garments, lingerie and underwear.

The invention also concerns the use of a lyocell filament yarn in any one of the above-described configurations in a women's apparel or menswear garment.

DETAILED DESCRIPTION

The invention is described below exemplarily with reference to the accompanying drawings and with reference to test samples.

Figure 1:
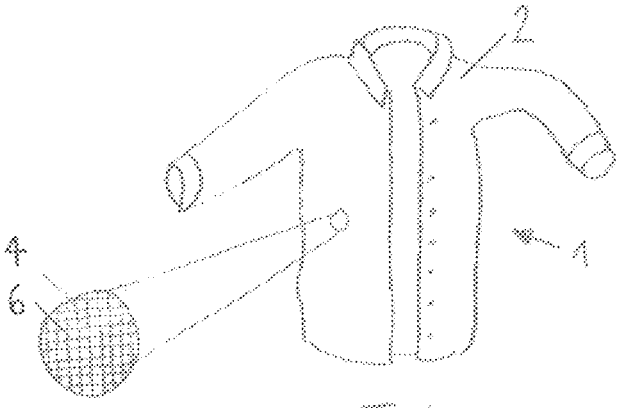
FIG. 1 shows schematically a women's apparel or menswear garment which at least partly is made from a silk like woven material.

FIG. 1 shows schematically a women's apparel or menswear garment 1 which at least partly is made from a silk-like woven material 2. The garment 1 is only schematically shown to be a shirt or blouse but not limited thereto. Depending of the width of the inventive silk-like woven fabric and its configuration, the garment 1 may be also a dress, a suit, a costume, a jacket, pants or parts of and/or on these garments.

The silk-like woven fabric 2 comprises weft yarns 4 and warp yarns 6, which preferably are twisted. At least one of the weft yarns 4 and the warp yarns contain lyocell filaments.

Figures 2, 3, 4:
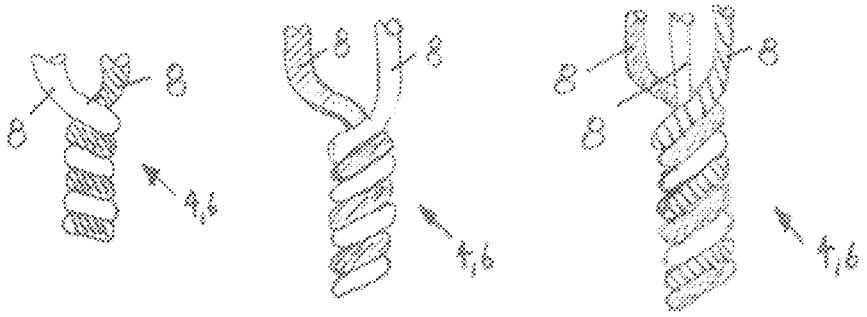
FIG. 2 shows an example of twisted warp and/or weft yarn.
FIG. 3 shows an example of twisted warp and/or weft yarn.
FIG. 4 shows an example of twisted warp and/or weft yarn.

Examples of twisted warp and/or weft yarns 6, 4 are shown in FIGS. 2 to 4. FIG. 2 shows a 2-ply yarn 4, 6 with an S-twist. At least one of the filaments 8 is a lyocell filament. FIG. 3 shows a 2-ply yarn 4, 6 in a Z-twist. Again, at least one of the filaments 8 is a lyocell filament.

FIG. 4 shows a 3-ply yarn 4, 6 in a Z-twist, of which at least one filament 8 is a lyocell filament.

The yarns 4, 6 may have a twist between 50 and 3500 TPM. The lighter the material, the higher the twist may be.

To investigate the superior quality of the silk-like woven fabric according to the invention over silk, samples were prepared and compared to comparative examples made from silk. Silk is the benchmark, against which any silk-like woven fabric has to compete. The samples of the inventive silk-like woven fabric are compared to comparative examples made of silk using the following tests:

Tests

A Martindale abrasion test according to DIN EN ISO 12947-2;

a Martindale pilling test according to DIN EN ISO 12945-2;

washing shrinkage according to DIN EN ISO 5077; from the absolute values of the shrinkage in both samples direction the sum was taken as a combined shrinkage;

fastness to rubbing according to ISO 105 X12;

AATCC durable press rating according to DIN EN ISO 15487;

air permeability according to DIN EN ISO 9237;

fastness according to DIN EN 20105-A02;

yarn strength in the warp and weft according to DIN EN ISO 2062.

If samples were subjected to washing, washing was performed according to DIN EN ISO 6330. All standards mentioned in this application are included by reference in their entirety.

Samples of the silk-like woven fabric were prepared as follows. Hereby, weight was determined according to DIN EN 12127. Yarn count in the weft and warp was performed in accordance with DIN 53820-3. Yarn density was determined according to DIN EN 1049/2.

Sample 1 and 2—Light-Weight Silk-Like Lyocell Wovens

Samples 1 and 2 were produced to obtain a light silk-like woven material of about 30 $gm^{-2}$.

Sample 1 is a silk-like woven fabric wherein both the weft and the warp were made of bright yarn of dtex 40f30. The yarn consisted of 100% lyocell filaments. The single filament count in the warp had a measured average linear density of 1.36 dtex, in the weft of 1.32 dtex. Each yarn had a twist of 1650 TPM (twists per meter). This material was benchmarked against a 100% silk Creponne fabric as comparative example 1.

Sample 2 is a silk-like woven fabric wherein the warp was made of 100% bright lyocell yarn of dtex 40f30 having 1650 TPM. The weft was made from 100% bright lyocell yarn of dtex 80f60 having 2000 TPM. The single filament count in the warp had a measured average linear density of 1.35 dtex, in the weft of 1.38 dtex. This material was benchmarked against a 100% silk Georgette fabric as Comparative Example 2. Table 1 gives an overview over the configuration, material and characteristics of samples 1 and 2, and comparative examples 1 and 2.

Sample 1 and 2 were treated identically as follows.

First, the fabric was processed on a jig dyeing machine by being pre-scoured in a bath that contained 2 g/l Anionic detergent and 2 g/l sodium carbonate for 30 minutes at 70° C. The fabric was then rinsed in warm water to clear the chemicals.

Then the fabric was dyed using the following steps: The dyebath was set at 60° C. with 50 g/l Sodium Sulphate. After 5 minutes running, 8% owg Remazol Midnight Black RGB (bi-reactive vinyl sulphone dye) was added portion wise over 15 minutes. After continuing to run the fabric end to end for 15 minutes, 18 g/l Sodium Carbonate was metered into the dyebath over 30 minutes. The dyeing continued for a further 30 minutes to allow time for the dyes to fix.

The dyebath was then drained and the fabric was washed in six baths as follows: (1) Warm water at 50° C., (2) neutralize at 70° C. for 10 minutes in 1 cc/l Acetic Acid (70%), (3) water at 80° C., (4) boil for 10 minutes at 95° C. with anionic detergent, (5) water at 80° C., (6) cold water. The washing was then completed by treatment for 15 minutes at 95° C. in 1 g/l anionic detergent and further rinsing until the washing liquors were clear.

The fabric was then removed from the jig dyeing machine and the fabric was dried on a stenter frame at 110° C. after being passed over a suction slot to remove excess water.

After drying the fabric was resinated as follows: Pad at 75% wet pick up in 45 g/l Fixapret ECO (DMDHEU resin from BASF), 20 g/l Siligen VN (softener), 14 g/l Siligen SIN (softener), 15 g/l Magnesium chloride, 1 g/l Acetic acid, 1 g/l Kieralon Jet B conc (wetting agent); pad at 70-80% pick up; dry at 120° C. followed by curing at 170° C. for 3 minutes on a stenter frame.

The black fabric was suitable for use as washable fabric for blouses, dresses, shirts.

The application of a resin prevented fibrillation occurring during laundering.

As can be seen from the test results, samples 1 and 2 of the inventive silk-like woven fabric is washable and has a combined shrinkage (some of absolute shrinkage in warp direction and of absolute shrinkage in weft direction) which is comparable to silk. The higher shrinkage in the weft direction of sample 2 results from the high TPM value of 2000. The AATCC durable press rating of samples 1 and 2 exceeds that of comparative examples 1 and 2, respectively, the same holds for color fastness.

Samples 3 and 4—Medium-Weight Silk-Like Lyocell Wovens

Samples 3 and 4 were produced to obtain a medium-weight silk-like woven material in the range of 70 to 100 gm-2. The configuration, material and properties of samples 3 and 4 are summarized in Table 2.

The warp of sample 3 consisted of 100% bright lyocell yarn made exclusively from lyocell filaments dtex 80f60 and having 200 TPM. The measured average linear mass of the single filament count was 1.35 dtex. The weft was made from bright lyocell staple fibre TENCEL Ne 40/1. According to the material analysis, the staple fibers had a linear mass of 1.3 dtex. The yarn was a Z ring yarn.

In sample 4, a 100% bright lyocell filament yarn dtex 80f60 having 200 TPM was used for the warp and the weft. The measured average linear mass of the filaments was 1.38 dtex in the warp and 1.32 dtex in the weft.

Samples 3 and 4 were processed on a jig dyeing machine, where the fabric was pre-scoured in a bath that contained 2 g/l Anionic detergent and 2 g/l sodium carbonate for 30 minutes at 70° C. The fabric was then rinsed in warm water to clear the chemicals.

The fabric was then dyed as follows. The dyebath was set at 60° C. with 50 g/l Sodium Sulphate. After 5 minutes running, 8% owg Remazol Midnight Black RGB (bi-reactive vinyl sulphone dye) was added portion wise over 15 minutes. After continuing to run the fabric end to end for 15 minutes, 20 g/l Sodium Carbonate was metered into the dyebath over 30 minutes. The dyeing continued for a further 40 minutes to allow time for the dyes to fix.

The dyebath was then drained and the fabric washed in six baths as follows: (1) Warm water at 50° C., (2) neutralize at 70° C. for 10 minutes in 1 cc/l Acetic Acid (70%), (3) water at 80° C., (4) boil for 10 minutes at 95° C. with anionic detergent, (5) water at 80° C., (6) cold water. The washing was then completed by treatment for 15 minutes at 95° C. in 1 g/l anionic detergent and further rinsing until the washing liquors were clear.

The fabric was then removed from the jig dyeing machine and the fabric dried on a stenter frame at 110° C. after being passed over a suction slot to remove excess water.

The black fabric was suitable for a wide range of textile applications and was suitable for domestic laundering without fibrillation occurring.

The fabric composition and properties of samples 3 and 4 are given in Table 2.

From a comparison of samples 1 and 2 on one hand and samples 3 and 4 on the other hand, it can be seen that color fastness was not influenced by the weight of the silk-like woven fabric. However, abrasion resistance and shrinkage improved considerably for the silk-like woven fabric having higher weight and lower TPM.

Samples 5 and 6—Heavy Silk-Like Lyocell Wovens

Two samples of heavy silk-like lyocell wovens having a plain/panama weave of 100-200 gm-$^{2}$ and suitable for use as heavy weight fabric for apparel endues were compared to silk Douppion Taffeta and Panama fabrics.

The heavy silk-like lyocell wovens were processed as follows on a jig dyeing machine in the same manner as samples 1 to 4 above.

Sample 5 was a Dupionne taffeta fabric of 168 gm-2. The structure of the warp and weft yarns was identical. Each yarn 180 filaments and was formed by a double filament structure containing both lyocell filaments as thick filaments and silk filaments as thin filaments, resulting in a composition of 75% lyocell filaments and 25% mulberry silk.

Sample 6 was a Dupionne Panama fabric having 202 gm-2 and containing the same yarns as sample 5.

Further details of the material and characteristics of samples 5 and 6 are given in Table 3.

Sample 5 was benchmarked against a silk Dupionne taffeta fabric of 167 gm-2 as comparative example 5. Sample 6 was compared to a silk Dupionne Panama of 180 gm-2 as comparative example 6.

As can be seen from Table 3, the inventive silk-like lyocell woven fabric of samples 5 and 6 showed superior air permeability and a great superiority in the Martindale abrasion test over the silk comparative examples. Further, shrinkage was considerably lower for the silk-like lyocell samples 5 and 6 compared to silk comparative examples 5 and 6.

The TSA Test

The TSA test was carried out to verify that the haptic qualities of the inventive silk-like lyocell woven fabric correspond to the haptic qualities of silk and that samples 1 to 4 are indeed silk-like.

The two predominant haptic qualities of silk are softness and smoothness. To assess the characteristics objectively, the TSA test was carried out.

The TSA test is described in Schloßer et al., "Griffbeurteilung von Textilien mittels Schallanalyse", Meilland Textilberichte, January 2102, p. 43-45, and in "Neue and Objektive Messtechnik für Softness-Analyse" in avr-Allgemeiner Vliesstoff Report May 2015, p. 99-101. Originally developed to measure softness and smoothness of tissues and non-wovens using sound spectra, it has been adapted to also evaluate the softness and smoothness of woven fabrics.

The TSA test was performed using a TSA Tissue Softness Analyzer device of emtec electronics GmbH, Germany, and the software ESM which is shipped with the TSA. The TSA measures a sound spectrum which results from pressing and rotating a star-like body against a sample fabric with a defined force. For testing, the fabric is clamped around its perimeter and unsupported otherwise, in particular opposite the rotating body. In the TSA test performed here, the software and its evaluation algorithm was not used. Instead, the sound pressure in dB $V^2$ rms as measured by the TSA at 7 kHz (TS7) was taken as an objective indirect measure of softness and the sound pressure in dB $V^2$ rms at 750 Hz (TS750) in the sound spectrum measured by the TSA was taken as an objective indirect measure of smoothness. The unit V corresponds to the rotational velocity of the rotating body. Using these values directly avoided any problems that may arise due to the EMS algorithm having been developed for tissue, and not for woven fabrics. A total of four probes were subjected to the TSA test for each sample.

For testing a fabric sample of 11 cm diameter was clamped as required by the TSA device and tested without stretching.

The results from the TSA tests are given in Table 4. Lower values of TS7 indicate higher softness and lower values of TS750 indicate higher value of smoothness.

As can be seen for the value TS750 and TS7, the four silk-like lyocell woven fabrics have different touch. A comparison of the value TS750 (smoothness) demonstrates that samples 1 and 2 are smoother than samples 3 and 4, which can be expected, as samples 3 and 4 represent a heavier, more coarse fabric. The value of TS7 (softness) shows that samples 3 and 4 are softer than samples 1 and 2 due to their greater thickness and the more loose yarn structure which results from a lower TSM value. This effect can also be observed by the higher softness of sample 1 compared to sample 2.

Comparison of the values TS7 and TS750 demonstrates that softness and smoothness of the silk-like fabric containing lyocell filaments are comparable to the softness and smoothness of the comparative examples made from silk. This is true both for the Georgette fabric (sample 2 and comparative example 2) and the Creponne fabric (sample 1 and comparative example 1).

Samples 7, 8 and 9 were produced as follows to demonstrate the possibility to add a peach-skin effect to the silk-like lyocell woven fabric.

Sample 7

A filament lyocell woven fabric was produced in a 2×1 twill structure at 120 gm-2 weight.

The fabric was first prepared open width on a conventional range to remove any sizes or lubricants present.

After initial preparation the fabric was treated in 40 g/l NaOH by impregnation on a chainless mercerizing machine, followed by washing in boiling water to remove the residual alkali.

The causticised fabric was then processed on the Then Airflow dyeing machine.

The dyeing was carried out using a conventional application method: The dyebath was set at 80° C. and 50 g/l Sodium Sulphate added over 10 minutes. The dye 3% owg Novocron Brilliant Red FN-3GL was then added in 3 portions over 20 minutes. The bath was circulated for 20 minutes before cooling at 1.5° C./min to 60° C. 20 g/l sodium carbonate was then added over 30 minutes. The dyeing was continued for a further 30 minutes to complete the fixation of the dyes. The dyebath was then drained before washing the fabric at 50° C. in water.

The fabric was then washed in 1 cc/l Acetic Acid (60%) to neutralize.

The washing was completed by treating the fabric in 1 g/l detergent at 95° C. for 10 minutes followed by rinsing at 50° C. and finally cold.

Then, the fabric was softened in 2% of a silicone softener, Megasoft JET-LF from Huntsman. The fabric was then unloaded from the dyeing machine and dried by tumbling on a Biancalani Airo rope tumbler. Finally the fabric was dressed on a stenter frame.

The resultant fabric is a peach effect woven fabric suitable for use in fashion dresswear or blouses.

Sample 8

A filament lyocell woven fabric was produced in a 2×1 will structure at 120 gm-2 weight.

The fabric was first prepared open width on a conventional range to remove any sizes or lubricants present.

After initial preparation the fabric was treated in 40 g/l NaOH by impregnation on a chainless mercerizing machine, followed by washing in boiling water to remove the residual alkali.

The fabric was dried on a stenter frame to dimensions to give a stable fabric. The fabric was then cut and sewn into a ladies blouse garment.

The garment was then dyed on a closed pocket garment dyeing machine at 10:1 liquid to goods ratio. The dyeing was carried out using a conventional application method: The dyebath is set at 80° C. and 50 g/l Sodium Sulphate added over 10 minutes. As dye 3% owg Novocron Brilliant Red FN-3GL was then added in 3 portions over 20 minutes. The bath was circulated for 20 minutes before cooling at 1.5° C./min to 60° C. 20 g/l sodium carbonate was then added over 30 minutes. The dyeing was continued for a further 30 minutes to complete the fixation of the dyes.

The dyebath was then drained before washing the fabric at 50° C. in water. The garment was then washed in 1 cc/l Acetic Acid (60%) to neutralize. The washing was completed by treating the fabric in 1 g/l detergent at 95° C. for 10 minutes followed by rinsing at 50 C and finally cold.

Finally, the garment was softened in 2% of a silicone softener, Megasoft JET-LF from Huntsman.

The garment was removed from the garment dyeing machine and after hydro-extracting was dried in a tumble drying machine. After drying the garment was pressed.

The finished garment had an attractive peach touch with a casual appearance from the puckered and highlighted seams.

Sample 9

A woven fabric was constructed using a filament lyocell warp (120 dtex) and a staple lyocell 1/50 Ne weft. The fabric was woven with 50 ends and 40 picks to a 2×1 twill construction.

The fabric was first singed to remove excess hairs, then prepared open width on a conventional range to remove any sizes or lubricants present.

After initial preparation the fabric was treated in 90 g/l NaOH by impregnation on a chainless mercerizing machine, followed by washing in boiling water to remove the residual alkali.

The causticised fabric was then processed on the Then Airflow dyeing machine.

The fabric was firstly subjected to treatment in 2 g/l Soda Ash with 2 g/l of a fabric lubricant, running for 60 minutes at 100° C., followed by rinsing to remove the alkali. This allows the generation of the so-called primary fibrillation.

The fabric was then treated in a cellulase enzyme to remove excessive fibrillation from the fabric surface as follows: The treatment bath was run for 45 minutes at 55° C. at pH 5.5 (set with acetic acid) in 1% Genencor BP CC. After the 45 minutes, the treatment batch was raised to 80° C. for 10 minutes to denature the cellulase.

After washing to remove excess chemicals and fiber lint, the fabric was dyed using a conventional application method: The dyebath was set at 80° C. and 50 g/l Sodium Sulphate added over 10 minutes. As dye 3% owg Novocron Brilliant Red FN-3GL was then added in 3 portions over 20 minutes. The bath was circulated for 20 minutes before cooling at 1.5° C./min to 60° C. 20 g/l sodium carbonate was then added over 30 minutes. The dyeing was continued for a further 30 minutes to complete the fixation of the dyes.

The dyebath was then drained before washing the fabric at 50° C. in water. The fabric was then washed in 1 cc/l Acetic Acid (60%) to neutralize. The washing was completed by treating the fabric in 1 g/l detergent at 95° C. for 10 minutes followed by rinsing at 50° C. and finally cold.

The fabric was softened in 2% of a silicone softener, Megasoft JET-LF from Huntsman. The fabric was then unloaded from the dyeing machine and dried by tumbling on a Biancalani Airo rope tumbler. Finally the fabric was dressed on a stenter frame.

The resultant fabric is a peach effect woven fabric suitable for use in fashion dresswear or blouses.

Bleaching Tests

To compare the resistance of a woven fabric using lyocell filaments to the resistance of silk against aggressive finishing, tests were performed in which samples and comparative examples were washed and bleached. Although these tests have been performed with a Denim lyocell configuration, the results apply identically to a silk-like lyocell material, as the resistance of the fiber is independent of the weave it is used.

As sample 10, a Denim 5978-100-814 was used where the warp was 100% cotton and the weft was a 100% lyocell filament yarn of 100 dtex, This material was benchmarked against a Denim 5840-814 having a 100% cotton warp and a 100% silk double plied weft as comparative example 7.

Sample 10 and comparative example 10 were fixed for 45 seconds at 195° C.

Strong Bleach

Sample 10 and comparative example 10 were bleached as follows:

Pre-scouring took place at a liquor ratio of 1:60 with 2.5 kg of fabrics and 150 l of liquor. For prewashing, 2 g/l Persoftal L, 0.5 g/l NaOH 100% (1 g/l NaOH 50%) and 0.2 g/l Lava Sperse KDS conc. were used. Pre-scouring was carried out for 20 minutes at 60° C. (maximum heating rate).

After that, cooling down to 40° C. and then cold rinsing with 300 l took place.

Bleaching took place at a liquor ration of 1:60 and 15 rpm, cold, for 30 minutes, again with 2.5 kg fabrics and 150 l liquor containing 2 g/l Soda and 0.4 g/l Lava Sperse KDS conc. The pH value was checked and maintained at pH 10. As bleaching agent, 3 g/l active chlorine (20 ml/l bleaching lye solution 150 g/l).

The liquor was then drained and the material was cold-rinsed with 300 l and warm rinsed with 150 l as above.

Dechlorination was performed with 2 ml/l hydrogen peroxide 50% for 30 minutes at 40° C.

Then cold rinsing with 300 l, warm rinsing with 150 l for 5 minutes at 50° C. (heating started with the rinsing), and cold rinsing with 300 l was performed.

Then, enzyme washing, followed by rinsing and reviving and tumble drying took place as follows:

After rinsing, enzyme washing was carried out at a liquor ratio of 1:60 again with 2.5 kg fabric and 150 l liquor at 22 rpm. The liquor contained 2 g/l Persoftal L, 3 g/l Peristal E and 0.3 g/l Lavasperse KDS conc. The pH value was maintained between pH 4.5-5. After heating to 55° C. at the maximum heating rate, the pH value was checked. before adding the enzyme and then the material was processed at 55° C. for 55 minutes. Then the material was heated to 85° C. and treated at 85° C. for 15 minutes.

The liquor was then drained and the material rinsed as follows: First, cold rinsing with 300 l, then warm rinsing with 150 l, where the heating started with the filling of the second rinsing step. Warm rinsing continued for 5 minutes at 50° C. Finally, cold rinsing took place with 300 l.

Reviving took place at a liquor ratio of 1:60 as above using 2% Tubingal RGH, 1% Tubingal RWM, 3 g/l Peristal E at 15 minutes and 40° C. after heating at the maximum rate.

The liquor was then drained and the material was tumble-dryed for 50 minutes at 80° C. and then allowed to cool down for 20 minutes.

From this, sample 11 and comparative example 11 were obtained.

Table 5 summarizes the configuration, material and properties of samples 10 and 11, and comparative examples 10 and 11, respectively. As can be seen, the silk material did not endure the bleach, whereas the lyocell filament yarn still exhibited sufficient yarn strength. Thus, it follows that the inventive silk-like woven lyocell fabric may be bleached, which gives a rise to a new class of fabrics, namely, bleached silk-like wovens.

In summary, it has been demonstrated that the lyocell filament woven fabric according to the invention has objective characteristics which are similar to silk with respect to softness and sweetness. The woven lyocell filament fabric therefore truly is silk-like.

For Creponne and Georgette fabric, the lyocell silk-like woven fabric according to the invention has much better abrasion resistance than silk as demonstrated by the Martindale abrasion test. The colorfastness of the new silk-like lyocell woven fabric is better by 1 to 0.5 degrees compared to silk.

The silk-like Creponne has better pilling characteristics compared to silk Creponne after washing. Further, the durable press rate after washing is improved over silk Creponne after washing.

The silk-like Georgette experiences less shrinkage than sill Georgette.

And, finally, the resistance of the silk-like lyocell woven fabric against aggressive finishing opens the door to the creation of new silk-like fabrics that were not available before.

TABLE 1

Comparison of Light-Weight Silk-Like Lyocell and Silk Woven Fabrics

| | Sample 1 | Comparative Example 1 | Sample 2 | Comparative Example 2 |
|---|---|---|---|---|
| fabric type | Creponne | Creponne | Crêpe Georgette | Crêpe Georgette |
| material (TPM = Twists per meter) | 100% Lyocell filaments dtex 40f30 bright TPM 1650 | 100% Silk | 100% Lyocell filaments dtex 40f30 bright TPM 1650 | 100% Silk |
| material weft | as warp | | 100% Lyocell filaments dtex 80f60 bright TPM 2000 | |
| material analysis warp | 100% Lyocell filament yarn single filament count 1.36 dtex bright dyed/finished | 100% Silk (Mulberry) filament S | 100% Lyocell filament yarn single filament count: 1.35 dtex bright dyed/finished | system 2:2: 2 yarns: 100% Silk (Mulberry) filament S 2 yarns: 100% Silk (Mulberry) filament Z |
| material analysis weft | 100% Lyocell filament yarn single filament count: 1.32 dtex bright dyed/finished | as warp | 100% Lyocell filament yarn single filament count: 1.38 dtex bright dyed/finished | as warp |
| Weight (g/m$^2$) | 31 | 20 | 74 | 40 |
| Density warp (ends/dm) | 382 | 557 | 691 | 503 |
| Density weft (ends/dm) | 333 | 467 | 307 | 420 |
| weave | plain | plain | plain | plain |
| Yarn count warp (dtex) | 46 | 17 | 42 | 38 |
| Yarn count weft (dtex) | 45 | 17 | 87 | 39 |
| Number of filaments warp | 30 | — | 30 | — |
| Number of filaments weft | 30 | — | 60 | — |
| abrasion test Martindale original | | | | |
| cycles-sample not destroyed | | 1500 | | 1500 |
| cycles to hole formation | | 2000 | | 2000 |

TABLE 1-continued

| Comparison of Light-Weight Silk-Like Lyocell and Silk Woven Fabrics | | | | |
|---|---|---|---|---|
| | Sample 1 | Comparative Example 1 | Sample 2 | Comparative Example 2 |
| after 1st wash | | | | |
| cycles-sample not destroyed | 5250 | 1500 | 5000 | 1000 |
| cycles to hole formation | 7000 | 2125 | 6750 | 1500 |
| laundering test 40° C., gentle wash, tumble drying del. washing shrinkage warp % | | | | |
| after 1st wash cond. 65/20 | −2.6 | −2.7 | −4.3 | −10 |
| after 5th wash cond. 65/20 | −3.7 | −2 | −5.7 | −12 |
| laundering test 40° C., gentle wash, tumble drying del. washing shrinkage weft % | | | | |
| after 1st wash cond. 65/20 | 0 | 0.7 | −6.3 | −6 |
| after 5th wash cond. 65/20 | 1.2 | 6 | −12.9 | −4.3 |
| AATCC durable press rating | | | | |
| after 1st wash | 5 | | 6 | |
| after 3rd wash | 5 | 6 | 6 | 4 |
| after 5th wash | 6 | 6 | 8 | 5 |
| test for color fastness ISO 105 A 02 | | | | |
| after 1st wash | 5.5 | 4.5 | 5.5 | 4.5 |
| after 5th wash | 4 | 4.5 | 4 | 3.5 |

TABLE 2

| Test Results for Medium-Weight Silk-Like Lyocell Fabrics | | |
|---|---|---|
| | Sample 3 | Sample 4 |
| fabric type | Medium weight silk-like woven | Medium weight silk-like woven |
| material (TPM = Twists per meter) | 100% Lyocell filament dtex 80f60 bright TPM 200 | 100% Lyocell filament dtex 80f60 bright TPM 200 |
| material weft | 100% Lyocell staple fiber bright Ne 40/1 | as warp |
| material analysis warp | 100% Lyocell filament yarn Single filament count: 1.35 dtex bright | 100% Lyocell filament yarn Single filament count: 1.38 dtex bright |
| material analysis weft | 100% Lyocell staple fiber single staplefiber count: 1.3 dtex bright ring yarn Z | 100% Lyocell filament yarn Single filament count: 1.32 dtex bright |
| Weight (g/m$^2$) | 96 | 75 |
| Density warp (ends/dm) | 507 | 536 |
| Density weft (ends/dm) | 259 | 361 |
| weave | plain | plain |
| Yarn count warp (dtex) | 80 | 80 |
| Yarn count weft (dtex) | Ne 40/1 (145 dtex) | 80 |

TABLE 2-continued

| Test Results for Medium-Weight Silk-Like Lyocell Fabrics | | |
|---|---|---|
| | Sample 3 | Sample 4 |
| Number of filaments warp | 60 | 60 |
| Number of filaments weft | — | 60 |
| abrasion test Martindale after 1st wash | | |
| cycles-sample not destroyed | 8000 | 8500 |
| cycles to hole formation | 9000 | 11500 |
| laundering test 40° C., gentle wash, tumble drying del. washing shrinkage warp % | | |
| after 1st wash cond. 65/20 | −2 | −1 |
| after 5th wash cond. 65/20 | −1.7 | −1 |
| laundering test 40° C., gentle wash, tumble drying del. washing shrinkage weft % | | |
| after 1st wash cond. 65/20 | 0 | −0.7 |
| after 5th wash cond. 65/20 | −0.3 | −0.7 |
| AATCC durable press rating | | |
| after 1st wash | 4 | 3 |
| after 3rd wash | 4 | 4 |
| after 5th wash | 4 | 4 |
| test for color fastness ISO 105 A 02 | | |
| after 1st wash | 5.5 | 5.5 |
| after 5th wash | 4.5 | 4 |

TABLE 3

Comparison of Heavy Silk-Like Lyocell and Silk Woven Fabrics

| | Sample 5 | Comparative Example 5 | Sample 6 | Comparative Example 6 |
|---|---|---|---|---|
| fabric type | Douppion Taffetà | Douppion Taffetà | Douppion Panama | Douppion Panama |
| material | 75% Lyocell filaments 25% Silk Douppion | 100% Silk | 75% Lyocell filaments 25% Silk Douppion | 100% Silk |
| material analysis-warp | double filament: filament thick: 100% Lyocell filament thin: 100% Silk (Mulberry) | 100% Silk (Mulberry) double plied yarn S filament | double filament: filament thick: 100% Lyocell filament thin: 100% Silk (Mulberry) | 100% Silk (Mulberry) double plied yarn S filament |
| material analysis-weft | as warp | 100% Silk (Mulberry) three plied yarn Z 2 filam. thick/1x thin filament | as warp | 100% Silk (Mulberry) three plied yarn Z 2 filam. thick/1x thin filament |
| Weight ($g/m^2$) | 168 | 150 | 202 | 180 |
| Density warp (ends/dm) | 220 | 212 | 215 | 211 |
| Density weft (ends/dm) | 183 | 180 | 280 | 248 |
| weave | plain | plain | panama | panama |
| Yarn count warp | 400 | 310 | 400 | 330 |
| Lyocell filament count in the yarn/warp | 300 | — | 300 | — |
| Yarn count weft | 420 | 400 | 420 | 420 |
| Lyocell filament yarn count in the yarn/weft | 300 | — | 300 | — |
| Number of Lyocell filaments warp | 180 | (167) | 180 | (118) |
| Number of Lyocell filaments weft | 180 | (78 + 161) | 180 | (150) |
| fastness to rubbing ISO 105 X12 | | | | |
| dry | 4.5 | 4 | 4.5 | 3.5 |
| wet | 3 | 4 | 2.5 | 2 |
| air permeability $l/m^2/s$ | 1160 | 855 | 850 | 570 |
| yarn strength-warp cN/tex | | | | |
| original | 28.4 | 32.8 | 29.5 | 36.6 |
| after 1st wash | 28.6 | 29.6 | 27.6 | 29.1 |
| after 5th wash | 25.3 | 26.5 | 24.2 | 24.1 |
| yarn strength-weft cN/tex | | | | |
| original | 29.6 | 31.7 | 30.7 | 34.5 |
| after 1st wash | 29.3 | 30.4 | 30.9 | 31.4 |
| after 5th wash | 29 | 25.7 | 29.7 | 31.3 |
| yarn elongation-warp % | | | | |
| original | 9 | 16.9 | 8.9 | 20.7 |
| after 1st wash | 9.8 | 15.8 | 8.6 | 18.2 |
| after 5th wash | 9 | 16.9 | 7.5 | 16.9 |
| yarn elongation-weft % | | | | |
| original | 9.4 | 13.7 | 9 | 13.7 |
| after 1st wash | 9.3 | 14.5 | 9 | 13 |
| after 5th wash | 9 | 11.6 | 8.7 | 14 |
| abrasion test Martindale original | | | | |
| cycles-sample not destroyed | 11500 | 5000 | 11000 | 4000 |
| cycles to hole formation | 17500 | 8000 | 14500 | 6000 |

TABLE 3-continued

| Comparison of Heavy Silk-Like Lyocell and Silk Woven Fabrics | | | | |
|---|---|---|---|---|
| | Sample 5 | Comparative Example 5 | Sample 6 | Comparative Example 6 |
| after 1st wash abrasion test Martindale | | | | |
| cycles-sample not destroyed | 19000 | 5750 | 10500 | 4500 |
| cycles to hole formation | 21500 | 7500 | 13000 | 7000 |
| pilling test of Martindale original | | | | |
| note after 1000 cycles | 4.5 | 4.5 | 4 | 4.5 |
| note after 2000 cycles | 4.5 | 4.5 | 4.5 | 4 |
| note after 5000 cycles | 5 | 5 | 5 | 4.5 |
| after 1st wash | | | | |
| note after 1000 cycles | 4.5 | 4 | 4.5 | 4 |
| note after 2000 cycles | 5 | 4.5 | 4.5 | 3.5 |
| note after 5000 cycles | 4.5 | 5 | 5 | 4 |
| laundering test 40° C. gentle, del. tumble dry after each wash washing shrinkage L % | | | | |
| after 1st wash cond. 20/65 | −2.3 | −7.6 | −3.7 | −13 |
| after 5th wash cond. 20/65 | −6.6 | −10.3 | −12 | −17.7 |
| washing shrinkage C. % | | | | |
| after 1st wash cond. 20/65 | 0.3 | −1 | 0.4 | −1.7 |
| after 5th wash cond. 20/65 | −1.7 | −1.6 | −1.3 | −2.3 |
| AATCC durable press rating appraisal of results after DIN | | | | |
| after 1st wash | 6 | 6 | 6 | 6 |
| after 5th wash | 6 | 5 | 6 | 5 |
| test for fastness ISO 105A02 | | | | |
| after 1st wash | 5.5 | 2.5 | 5.5 | 7 |
| after 5th wash | 4 | 2 | 4 | 2.5 |

TABLE 4

| Results of TSA tests | | | | | | |
|---|---|---|---|---|---|---|
| | Sample 3 | Sample 4 | Sample 1 | Comparative Example 2 | Sample 2 | Comparative Example 1 |
| TS750 | 29 | 19 | 1 | 1 | 6 | 3 |
| TS7 | 5 | 6 | 9 | 11 | 14 | 12 |

TABLE 5

| Samples for the Bleaching Tests | | | | |
|---|---|---|---|---|
| | Sample 10 | Comparative Example 10 | Sample11 | Comparative Example 11 |
| design code | Denim 978-100-814 | Denim 840-814 | Denim 978-100-814 | Denim 840-814 |
| finishing | original fixed | original fixed | Chloride strong bleached | Chloride strong bleached |

TABLE 5-continued

| Samples for the Bleaching Tests | | | | |
|---|---|---|---|---|
| | Sample 10 | Comparative Example 10 | Sample11 | Comparative Example 11 |
| material | 45% % Lyocell filament yarn 55% Cotton | 59% Cotton 41% Silk | 45% % Lyocell filament yarn 55% Cotton | 59% Cotton 41% Silk |
| material warp | 100% Cotton | 100% Cotton | 100% Cotton | 100% Cotton |
| material weft | 100% Lyocell filament yarn 100 dtex bright | 100% Silk double plied yarn filament | 100% Lyocell filament yarn 100 dtex bright | 100% Silk double plied yarn filament |
| Weight (g/m$^2$) | 128 | 171 | 115 | — |
| weave | Twill | Twill | Twill | Twill |
| Yarn count warp | Nm 74/1 (135 dtex) | Nm 60/1 (165 dtex) | Nm 74/1 (135 dtex) | Nm 60/1 (165 dtex) |
| Yarn count weft | 100 | 161 | 100 | 161 |
| Single yarn count weft | 100 | 72 | 100 | 72 |
| Number of Lyocell filaments weft | 60 | — | 60 | — |
| yarn strength-warp cN/tex | | | | |
| cond. 20/65 | 14.5 | 15.6 | 4.9 | no material |
| wet | 16.2 | 16 | 8.6 | no material |
| yarn strength-weft cN/tex | | | | |
| cond. 20/65 | 27.5 | 25.5 | 2.3 | no material |
| wet | 13 | 18.7 | 2.2 | no material |
| yarn elongation-warp % | | | | |
| cond. 20/65 | 4.4 | 5.2 | 2.8 | no material |
| wet | 7.7 | 7.3 | 6.8 | no material |

What is claimed is:

1. A woven fabric made from weft yarn and warp yarn, wherein at least one of the weft yarn and the warp yarn comprises at least one lyocell filament yarn having more than 1,500 twists per meter (TPM) and less than 3,500 TPM and a linear mass density of no more than 150 dtex, wherein the sum of the absolute values in percent of shrinkage in warp direction and of the shrinkage in weft direction of the fabric determined according to DIN EN ISO 5077 after a first washing according to DIN EN ISO 6330 is no more than 11% in a conditioned state 65/20.

2. The woven fabric according to claim 1, wherein the at least one lyocell filament yarn comprises a linear mass density of no more than 100 dtex.

3. The woven fabric according to claim 1, wherein after the first wash according to DIN EN 6330, the fabric exhibits a wear number of at least 6,000 Martindale in a Martindale abrasion test according to DIN EN ISO 12947-1:2007-04 to hole formation.

4. The woven fabric according to claim 1, wherein the fabric has an AATC durable press rating determined according to DIN EN ISO 15487 of at least 3 after the first washing according to DIN EN ISO 6330.

5. The woven fabric according to claim 1, wherein the fabric has a grade according to the test for color fastness according to DIN EN 20105 A02 of not worse than 5 after the first washing according to DIN EN ISO 6330.

6. The woven fabric according to claim 1, wherein the fabric has a smoothness (TS750) value of no more than 8.

7. The woven fabric according to claim 1, wherein the fabric has a softness (TS7) value of no more than 10.

8. The woven fabric according to claim 1, wherein the fabric has a smoothness (TS750) value of no more than 7.

9. The woven fabric according to claim 1, wherein the fabric has at least 3 Martindale after 2,000 cycles determined according to the Martindale pilling test in DIN EN ISO 12945-2.

10. The woven fabric according to claim 1, wherein the fabric is one of a crepe and dupionne.

11. Women's apparel or menswear garment, bed linen (sheeting), shell fabrics, flat linen or fitted sheets comprising or consisting of a woven fabric according to claim 1.

12. A method of making a garment, the method comprising producing at least one lyocell filament yarn in a woven fabric having more than 1,500 twists per meter (TPM) and less than 3,500 TPM and a linear mass density of no more than 150 dtex, wherein the sum of the absolute values in percent of shrinkage in warp direction and of the shrinkage in weft direction of the fabric determined according to DIN EN ISO 5077 after a first washing according to DIN EN ISO 6330 is no more than 11% in the conditioned state 65/20.

* * * * *